US005447761A

United States Patent [19]

Lafond

[11] Patent Number: 5,447,761

[45] Date of Patent: Sep. 5, 1995

[54] SEALANT STRIP INCORPORATING FLEXING STRESS ALLEVIATING MEANS

[76] Inventor: Luc Lafond, 23 Woodvalley Drive, Etobicoke, Ontario N9A 4H4, Canada

[21] Appl. No.: 871,071

[22] Filed: Apr. 20, 1992

[30] Foreign Application Priority Data

Apr. 19, 1991 [CA] Canada ..... 2040843

[51] Int. Cl.[6] ..... E06B 3/24

[52] U.S. Cl. ..... 428/34; 428/192; 52/786.13

[58] Field of Search ..... 428/34, 121, 122, 212, 428/174, 192; 52/172, 788–790, 171.3; 154/102, 109

[56] References Cited

U.S. PATENT DOCUMENTS

| | | | |
|---|---|---|---|
| 2,273,733 | 2/1942 | Paddock | 428/34 |
| 2,625,717 | 1/1953 | Wampler et al. | 428/34 |
| 2,708,774 | 5/1955 | Seelen | 428/34 |
| 3,280,523 | 10/1966 | Stroud et al. | 52/788 |
| 4,113,905 | 9/1978 | Kessler | 428/34 |
| 4,393,105 | 7/1983 | Kreisman | 428/34 |
| 4,564,540 | 1/1986 | Davies et al. | 428/34 |
| 4,658,553 | 4/1987 | Shinagawa | 428/34 |
| 4,850,175 | 7/1989 | Berdan | 52/790 |
| 4,942,704 | 7/1990 | King | 52/172 |

*Primary Examiner*—Donald J. Loney
*Attorney, Agent, or Firm*—McFadden, Fincham

[57] ABSTRACT

There is disclosed an adhesive sealant strip for positioning between a pair of opposed substrates in which there is included a continuous channel. The, channel extends outwardly from the atmosphere between the opposed substrates when the strip is positioned therebetween and permits flexing of the strip material. The flexing substantially alleviates bending stress of the strip enabling a positive adhesive seal to be maintained between substrate engaging surfaces of the strip and substrates engaged therewith.

8 Claims, 2 Drawing Sheets

SEALANT STRIP INCORPORATING FLEXING STRESS ALLEVIATING MEANS

BACKGROUND OF THE INVENTION

This invention relates to sealant strips and more particularly, it relates to sealant strips for insulated glass assemblies including a channel therein to alleviate flexing stress at the juncture of the strip to a substrate.

FIELD OF THE INVENTION

Insulating glass is normally formed of two or more sheets or lites of glass joined together about their periphery by means of a sealant strip between these sheets. Conventional sealant strips are typically formed of a body of e.g. solid butyl rubber which may or may not include a metal reinforcement within the body. In other cases, sealant strips may also be formed of an extruded foam material of a synthetic nature and which typically must include a moisture and air impermeable thin backing of e.g. Mylar ® applied by adhesive to two or three sides of the strip.

Numerous advancements have been made in terms of the insulating capacity of the strips including the fabrication of strips employing a plurality of various materials to enhance the insulation capacity.

Further, different desiccants and the positioning of the same within or on strip material have been set forth in the art in an attempt to combat moisture penetration within the atmosphere between a pair of substrates.

Typically, the known strips employ a butylated polymer as the main component of the strip since this material offers the required insulation capacity as well as adhesiveness particularly well adapted for adherence to glass substrates.

The insulating body will also be chosen, depending on the particular use of the product of the present invention and the type of assembly to be formed, to have certain other characteristics such as gas impermeability, moisture impermeability and the like. To this end, the particular polymeric material may be selected by those skilled in the art to have such properties where desired.

Although the known strips proposed in the art are effective, none addresses a key issue critical to the effectiveness of the insulated assembly, namely, the juncture or seal interface between the strip and substrate surface engaged therewith.

One can clearly see that regardless of the insulation quality inherent to the strip, the effectiveness of the same is principally limited by the strip to substrate interface. This is a source of difficulty in that the choice material used in the fabrication of the insulated assemblies, i.e. butylated polymers are limited in both flexability and compressibility properties. Some degree of these properties is associated with such polymers, however, when the assembly is subjected to flexing etc., the juncture or seal of the substrate to the strip is subjected to the flexing force and this inevitably leads to disruption at the interface and thus an ineffective seal.

Such a drawback has a dramatic effect on the assembly to the point where the same is rendered noninsulating.

SUMMARY OF THE INVENTION

It is therefore readily apparent that there exists a need for a sealant strip for insulated assemblies which is capable of flexing in order to maintain an effective seal between substrates engaged therewith. Applicant with the present invention, satiates this need by providing a sealant strip for application between a pair of opposed substrates, the improvement comprising:

an elongate insulating body, the body having a pair of spaced apart substrate engaging surfaces being adapted for engagement with a substrate surface, the body including a pair of spaced apart faces, one of the faces having stress relieving means operatively associated therewith for relieving stress at the substrate engaging surfaces when the body is engaged between the substrates whereby engagement is maintained between the engaging surfaces and the substrates.

In greater detail of the present invention, the insulating body may be chosen from butylated polymers, polysilicones, ethylene polymers, polyamides or other materials offering effective insulation. In most cases, the insulating body will be formed of a polymer having adhesive characteristics; however, where the polymer chosen for the insulating body does not have a sufficient degree of adhesiveness to adhere to a substrate surface, normally an adhesive will be provided on its surface so as to provide an adequate binding relationship with a substrate.

Generally speaking, for the insulating glass industry, the insulating strip or body will have appropriate dimensions which in turn, will also vary depending on the size and type of glass lites; typically, this strip will be from e.g. ¼" by ¼" to 1" by 1" or more depending on its application.

In a particularly preferred form, the insulating body is provided with a channel or recess extending within the body. The channel which may be formed within the body during an extrusion process, has been found to be particularly useful as a stress relieving means at the interface between the sealant strip and substrate engaged therewith.

The provision of the channel advantageously increases the flexibility of the strip to enable the same to flex at the channel rather than at the interface which results in the disruption and/or destruction of the seal.

The channel preferably extends within the strip on the side facing outwardly of the atmosphere between the substrates.

Generally, the shape of the channel may take numerous forms including a rectangular, square, triangular, arcuate or polygonal shape. Any shape may be formed within the body which permits enhanced flexibility of the same.

In order to impart a degree of resiliency to the channel, a foamed cellular material may be included therein. The foamed material is useful to provide a "restoration force" to the insulating body channel when the assembly is flexed or compressed. Typical materials for the foam may be, as representative examples, polyurethanes, polyolefins, polystyrenes, polyvinylchlorides or copolymers of these.

Depending on the size of the strip and hence the channel, the density of the foam material may vary considerably.

The foam material may be secured within the channel using suitable means or may be coextruded with the sealant strip in a single operation.

Depending on the requirements of the insulated assembly, the insulating body and/or foam material may include a matrix dispersion of a suitable desiccant therein. Any of the suitable desiccants may be employed to this end to include e.g. calcium chloride, silica gel, zeolites, etc.

The channel may further include, in order to protect the foamed material, a layer of flexible material overlying the channel. The material may be selected from moisture impervious materials, such as thermoplastic or thermoset materials, e.g. polyolefins, polyamides or the like.

In another aspect of the present invention there is also provided a method of forming a sealant strip having stress relieving means operatively associated with it which comprises, in one embodiment, the steps of providing a length of elongate insulating body, the body having a pair of spaced apart substrate engaging surfaces adapted for engagement with a substrate surface and further including a pair of spaced apart faces, forming stress relieving means in one of said faces so that the stress relieving means is operatively associated therewith for relieving stress in the sealant strip.

In another embodiment of the present invention, when the sealant strip is comprised of an extruded polymeric material, the sealant strip may be extruded with a channel in one of the faces so as to provide stress relieving means in the strip; in other embodiments, a previously formed sealant strip may be subjected to the action of cutting or grooving means so as to form a recess or channel in one face of the body to thereby provide the stress relieving means.

Following formation of the channel or groove in the body, the further step of inserting into the groove or channel thus formed, a length of flexible material may be carried out. To this end, suitable foam or other like polymeric materials capable of flexing in a compressive and/or expansive sense may be included in the groove. If desired, such a length of material may be retained in the channel or groove by suitable means such as adhesive or by means of a suitable covering layer.

Still further, in the case of extruded sealant strips the insulating body as it is extruded may be extruded in a configuration of the desired shape to provide the channel or groove therein; in certain extrusion techniques, known as coextrusion, a foam may be extruded at approximately the same time as formation of the body so as to result in a co-extruded product being produced by the extrusion process and apparatus.

In other cases, depending on the nature of the material intended to be inserted into the recess or channel, the additional length of material may be inserted as a subsequent operation using either continuous or particulate material. If the material inserted into the groove is of a particulate nature, then suitable means for retaining it in operative relationship with the groove will be employed such as a retaining cover or sheet of polymeric material enclosing the particulate material in the groove.

In some cases, depending on the nature of the substrate, only limited stress relieving characteristics may be required for the insulating body. In other cases, higher stress relief values may have to be provided where, for example, the present invention is employed in insulated glass structures of a relatively large size or weight. Thus, the insulating body may, on certain occasions, not require any additional component inserted into the recess or channel while in other cases, the inclusion of e.g. foam or the like in the channel would be desirable.

BRIEF DESCRIPTION OF THE DRAWINGS

Having thus generally described the invention, reference will now be made to the accompanying drawings illustrating preferred embodiments and, in which.

DESCRIPTION OF THE PREFERRED EMBODIMENTS

Figure 1:
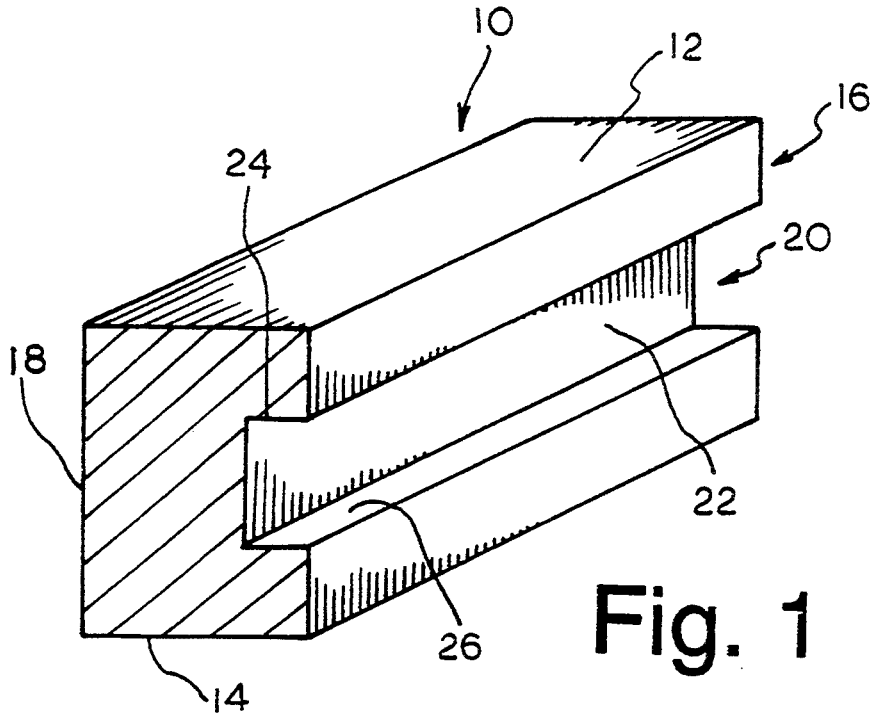
FIG. 1 is a perspective view of the strip according to the present invention.
Figure 2:
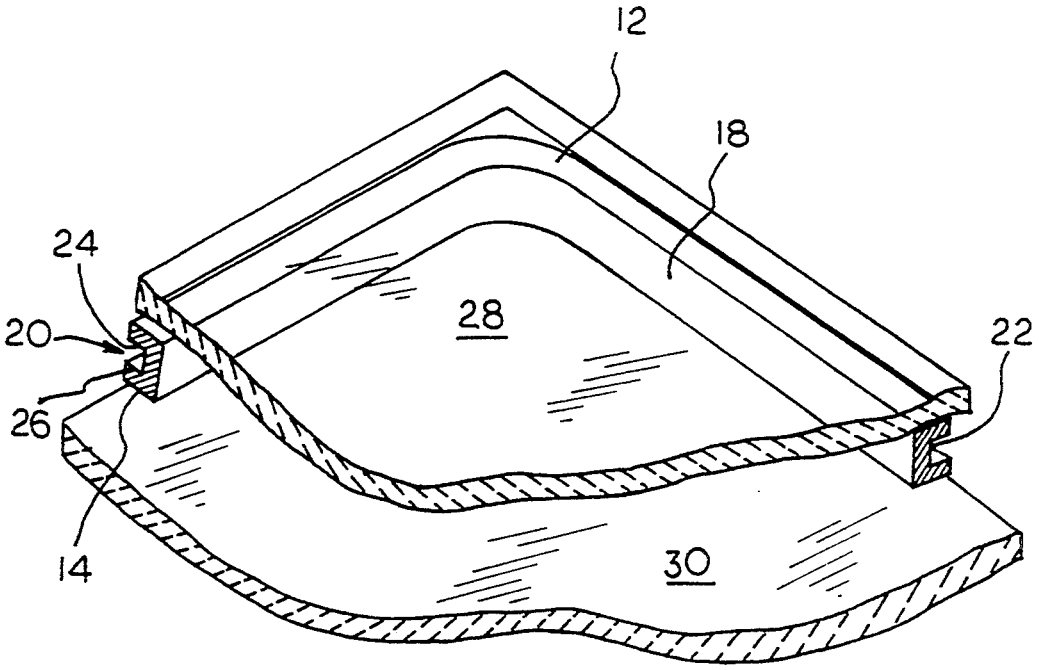
FIG. 2 is a perspective view of the strip in situ between opposed substrates.

Referring now to FIGS. 1 and 2, shown is a perspective view of the sealant strip and the same as positioned between a pair of opposed substrates according to the present invention. The strip 10, generally comprises an elongate insulating body of a suitable polymeric substance. The polymer may be selected from those which are pliable and which provide insulation capacity and adhesiveness. In a preferred form, the polymer of the sealant strip comprises a butyl polymer well known to those skilled in the art. Such a material is particularly useful for insulated glass assemblies since it provides a tacky surface to which glass or other substrates may be adhered while providing sufficient rigidity for maintaining structural integrity of a glass assembly.

The body 10 includes a pair of opposed surfaces 12 and 14 and a pair of spaced apart faces 16 and 18. Extending centrally within face 16 there is included a continuous channel 20. The channel 20 may extend from about 1/5 to about ½ between faces 16 and 18 with respect to face 16. The width and depth of the channel 20 within body 10 may vary depending on the size of substrates to be employed with the strip.

In the example, the channel 20 comprises a C-shaped channel when viewed longitudinally and as such includes a base portion 22 substantially parallel and spaced from face 18. Extending transversely from the base 22 are arms 24,26 which are generally parallel to surfaces 12 and 14, respectively.

The incorporation of the channel 20 within the body 10 has been found to be particularly useful for alleviating stress and, in particular, sealing stress at the seal juncture of the substrate engaging surfaces 12 and 14 when in sealing relationship with substrates 28 and 30. In conventional strips not providing any stress relieving means, the seal, when the assembly is formed, handled etc., is subject to stress which can have a deleterious affect on the seal. In such a situation, the seal may be broken in some areas which obviously destroys the effectiveness of the strip to insulate the atmosphere between substrates engaged therewith. Concomitant with this problem are inherent energy losses and thus greater expenditures therefor.

By including the channel 20 in the body 10, the limitations described herein are substantially obviated. The channel 20 allows a degree of flex and/or compression when the substrates 28 and 30 are adhesively engaged with surfaces 12 and 14, respectively. As such, during the handling, manipulation, temperature extremes, etc. the adhesive engagement is maintained.

Having regard to the above, the channel 20 preferably extends outwardly of the atmosphere between the substrates 28 and 30 as illustrated in FIG. 2. In order to maintain a substantially arid atmosphere between the substrates 28 and 30, the body may include a desiccant material e.g. calcium chloride, silica gel, zeolites etc. matrixed in the body 10 or, alternatively, face 18 may include a strip of desiccant material positioned thereover.

Figure 3:
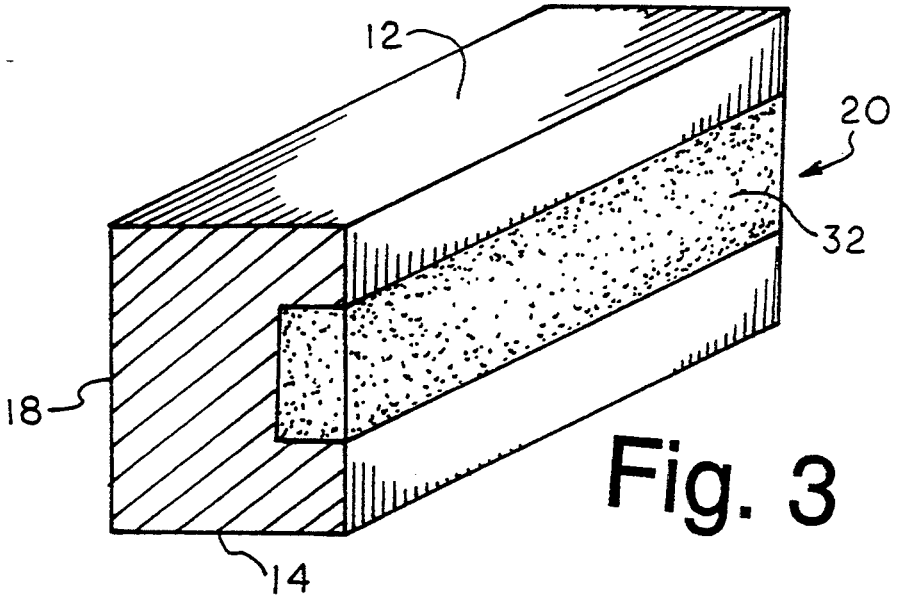
FIG. 3 is a perspective view of the strip of FIG. 1 with the foamed material therein.

In order to aid in both dampening the compression and to provide resiliency to the strip 10 at channel 20, the channel can include a suitable foam material, as illustrated in FIG. 3, having resiliency as an inherent property. A suitable foam material may be, for example, polyurethane, polypropylene, polystyrene etc. The foam 32 may be fixed within the channel 20 by suitable means e.g. chemical or thermal bonding or alternatively, may be coextruded with the strip 10. The incorporation of the foamed material 32 not only imparts resilient flexing to the channel 20 but also serves to insulate the strip as well. A flexible layer of insulating and substantially moisture proof material e.g. Tedlar® or Mylar® may be included to overlie the channel 20, housing the foamed material 32 therein, to protect the same.

In addition, the foamed material 32 may include, matrixed therein, a suitable desiccant material as described herein previously.

Figure 4:
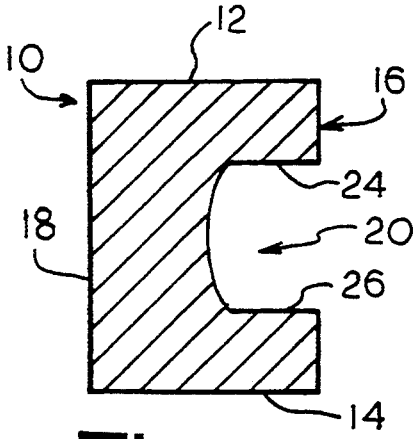
FIG. 4 is an alternate embodiment of the strip of FIG. 1.
Figure 5:
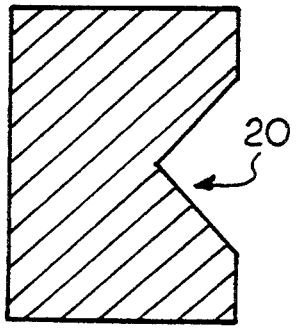
FIG. 5 is a further alternate embodiment of the strip of FIG. 1.
Figure 6:
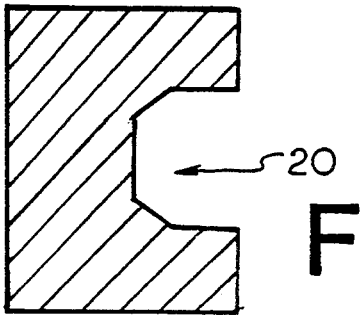
FIG. 6 is yet another alternate embodiment of the strip of FIG. 1.

Although the channel 20, in the example, has been represented as a C-shaped channel, it will be readily appreciated that the same may assume various profiles. FIGS. 4 through 6 generally illustrate various alternatives, namely, an arcuate triangular, and a polygonal shape, respectively. Other alternatives will be readily appreciated by those skilled in the art. The shape of the channel 20 thus may be any shape which allows flexing of the strip to relieve stress, as discussed herein previously, at the juncture or seal of the substrates 28,30 at the substrate engaging surfaces 12,14 of the strip 10. It will be appreciated that the foam material 32 will alter in shape accordingly depending on the shape of the channel 20.

As those skilled in the art will realize, these preferred illustrated details can be subjected to substantial variation, without affecting the function of the illustrated embodiments. Although embodiments of the invention have been described above, it is not limited thereto and it will be apparent to those skilled in the art that numerous modification form part of the present invention insofar as they do not depart from the spirit, nature and scope of the claimed and described invention.

I claim:

1. A glass assembly having an interior atmosphere and comprising a pair of glass lites and a sealant strip between and sealed directly to inner surfaces of said lites, wherein said strip comprises:

an elongate insulating body having a peripheral edge;

said body including an inner face at peripheral edge and an outer face, said inner and outer faces being spaced apart;

a channel extending within said insulating body exteriorly of said atmosphere at said peripheral edge, said channel having a width and extending into said body through said inner face; said channel forming a pair of spaced apart flexible glass lite engaging arms having inner ends at said inner face, said inner ends spaced apart said width of said channel, said lite engaging arms flexibly extending from said body and each engaging a said inner surface of a glass lite, whereby sealed engagement is maintained between said engaging arms and said glass lites when said body is subjected to stress.

2. The strip as defined in claim 1, wherein said channel is continuous.

3. The strip as defined in claim 2, wherein said channel extends inwardly between said spaced apart faces for a distance of about 1/5 to about ½ of the distance between said faces.

4. The strip as defined in claim 1, wherein said channel is centrally located in said inner face.

5. The strip as defined in claim 1, wherein said insulating body includes desiccant material therein.

6. The strip as defined in claim 1, wherein said insulating body is substantially free of desiccant material.

7. The strip as defined in claim 1, wherein said insulating body comprises a polymeric material.

8. The strip as defined in claim 7, wherein said polymeric material is pliable.

* * * * *